US007420443B2

(12) United States Patent
Paynter

(10) Patent No.: US 7,420,443 B2
(45) Date of Patent: Sep. 2, 2008

(54) WAVEGUIDE INTERFACE ADAPTER AND METHOD OF MANUFACTURE

(75) Inventor: Jeffrey D Paynter, Momence, IL (US)

(73) Assignee: Commscope, Inc. of North Carolina, Hickory, NC (US)

( * ) Notice: Subject to any disclaimer, the term of this patent is extended or adjusted under 35 U.S.C. 154(b) by 178 days.

(21) Appl. No.: 11/382,663

(22) Filed: May 10, 2006

(65) Prior Publication Data

US 2007/0262837 A1 Nov. 15, 2007

(51) Int. Cl.
*H01P 1/04* (2006.01)

(52) U.S. Cl. ..... 333/254; 333/255

(58) Field of Classification Search ..... 333/254, 333/255

See application file for complete search history.

(56) References Cited

U.S. PATENT DOCUMENTS

| | | | | |
|---|---|---|---|---|
| 3,076,159 | A | 1/1963 | Vaughan et al. | |
| 3,374,450 | A | 3/1968 | Steward | |
| 3,587,010 | A | 6/1971 | Walsh | |
| 3,708,873 | A | 1/1973 | Floyd, Jr. | |
| 3,821,670 | A * | 6/1974 | Thompson | 333/255 |
| 3,942,141 | A | 3/1976 | Kaffenberger | |
| 4,590,785 | A | 5/1986 | Morris | |
| 4,638,273 | A | 1/1987 | Foglesonger et al. | |
| 4,845,448 | A | 7/1989 | Olsson | |
| 6,267,415 | B1 | 7/2001 | Frank | |
| 6,448,875 | B1 | 9/2002 | Sciarrino | |
| 6,710,674 | B2 | 3/2004 | Pitschi | |
| 6,710,685 | B1 | 3/2004 | Sciarrino | |

FOREIGN PATENT DOCUMENTS

| | | |
|---|---|---|
| EP | 0287538 | 10/1988 |
| GB | 1401409 | 5/2006 |

OTHER PUBLICATIONS

European Search Report: Application No. 07106790.4 issued to Applicant's attention Sep. 28, 2007 (for EPO Patent Application claiming priority from present U.S. Appl. No. 11/382,663).

* cited by examiner

*Primary Examiner*—Benny Lee
(74) *Attorney, Agent, or Firm*—Babcock IP, PLLC

(57) ABSTRACT

A waveguide interface for a waveguide having a split ring with a first half and a second half joined by a web portion. The split ring first half and second half having an inner surface configured to mate with an exterior of the waveguide, the first half and the second half foldable towards each other and around the exterior of the waveguide, along the web portion. An overbody with a bore is dimensioned to receive the waveguide therethrough; the bore having a shoulder at an interface end dimensioned to receive the split ring.

19 Claims, 10 Drawing Sheets

WAVEGUIDE INTERFACE ADAPTER AND METHOD OF MANUFACTURE

BACKGROUND

1. Field of the Invention

This invention relates to waveguides and waveguide interconnection interfaces. More particularly, the invention relates to a waveguide interconnection interface with improved manufacturing cost efficiencies and ease of installation.

2. Description of Related Art

Waveguides are commonly used for transmitting electromagnetic wave energy from one point to another.

Waveguide interfaces field mountable upon a waveguide end via a mechanical clamping action are known. To retain the waveguide interface upon the waveguide end, a two part split ring with an inner surface that keys with corrugations of the waveguide exterior is fitted around the waveguide. The two part split ring is retained against the waveguide by an overhousing that the two part rings fit into, secured in place via a plurality of screws. The prior waveguide interfaces were sealed by a gasket positioned between the overhousing and the outer surface of the waveguide, compressed by the split rings as they are fastened against the overhousing. Once the waveguide interface is mounted, a protruding end of the waveguide may be flared against the split rings.

Where the waveguide corrugations are helical, each separate half of the prior split ring has a different inner surface for mating with opposing sides of the waveguide exterior, but otherwise has a similar appearance. This similarity creates a significant chance of erroneously delivering to the installer two identical split ring halves rather than the required two mating split ring halves, resulting in an unusable assembly. Also, mounting and retaining the split ring(s) around the waveguide prior to fastening within the overhousing is difficult. Prior waveguide interfaces sometimes applied an additional retaining band or o-ring gasket for this purpose. Groove features to accommodate the additional retaining band increase the size of the resulting waveguide interface. As a result, the overall weight of the assembly is increased along with spacing requirements alongside other equipment.

Another problem with the prior waveguide interfaces is the plurality of unique components and fasteners required. The plurality of small parts/fasteners creates an opportunity for delivery errors and or for the accidental loss of a part that may also generate a drop hazard. Any of which results in an unusable interface assembly at the point of installation.

The prior waveguide interfaces applied metal machining technologies to form the overhousing, split rings, threaded screw holes and the precision surfaces that key with the waveguide corrugations. Formed from metal alloys, such as brass, these assemblies have a significant materials cost and weight. Also, precision machining, co-ordination and inventory of each of these components are significant cost factors.

The increasing competition for waveguide interfaces has focused attention on cost reductions resulting from increased materials, manufacturing and installation efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention, like reference labels appearing in the various figures referring to the same feature.

DETAILED DESCRIPTION

Figure 1:
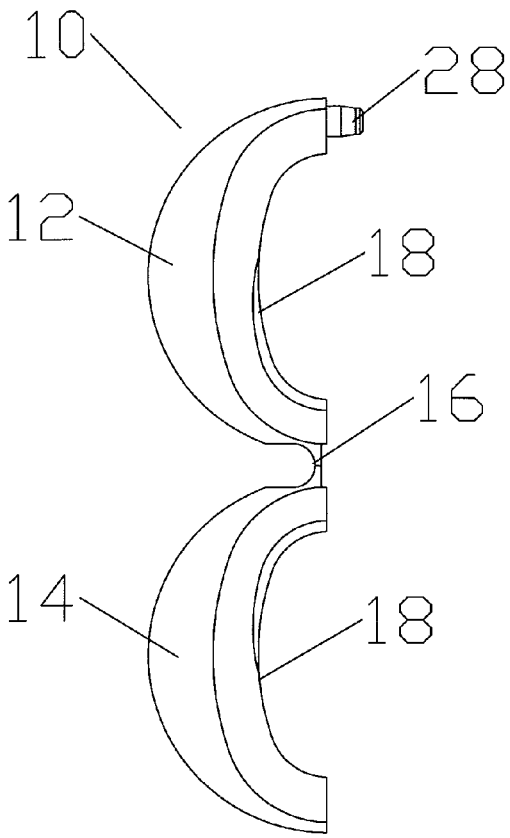
FIG. 1 is a side schematic view of a split ring, according to an exemplary embodiment of the invention, in an initial casting configuration.
Figure 2:
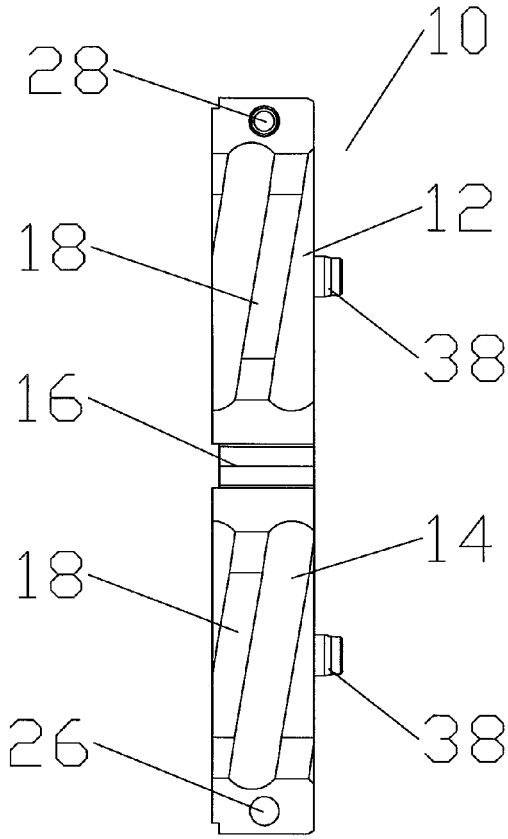
FIG. 2 is a schematic end view of a split ring, according to an exemplary embodiment of the invention, in an initial casting configuration.
Figure 3:
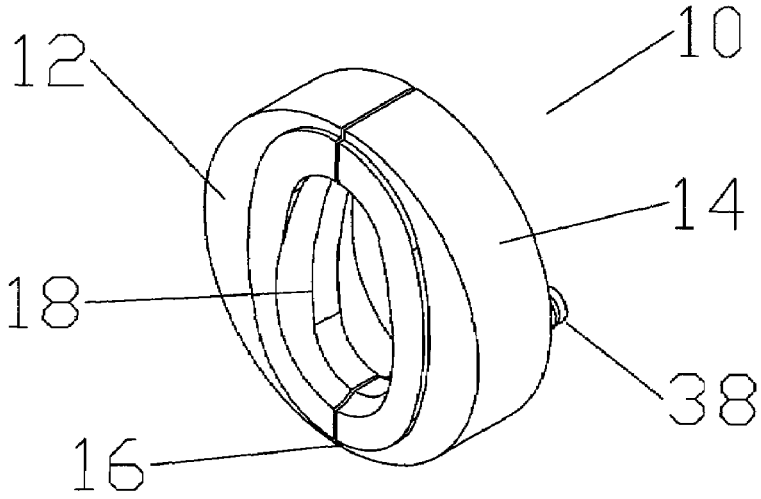
FIG. 3 is a schematic isometric view of the split ring of FIGS. 1 and 2, folded along the web portion and interconnected end to end.
Figure 4:
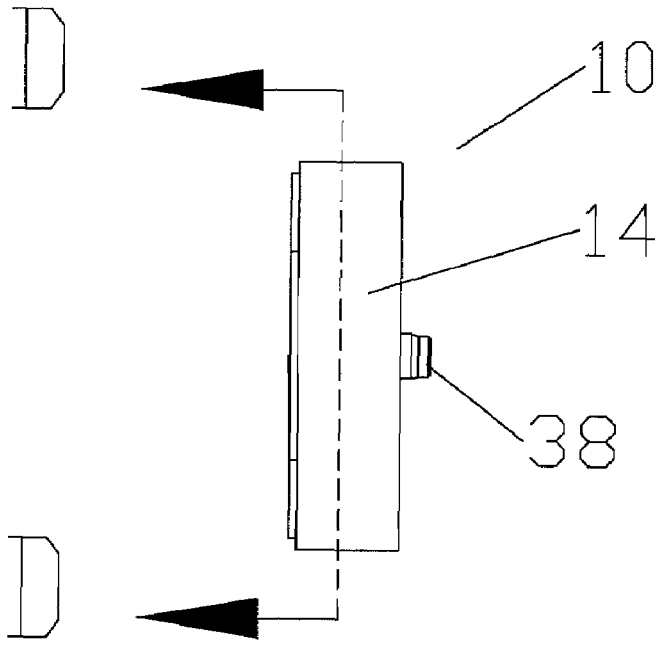
FIG. 4 is a schematic end view of FIG. 3.
Figure 5:
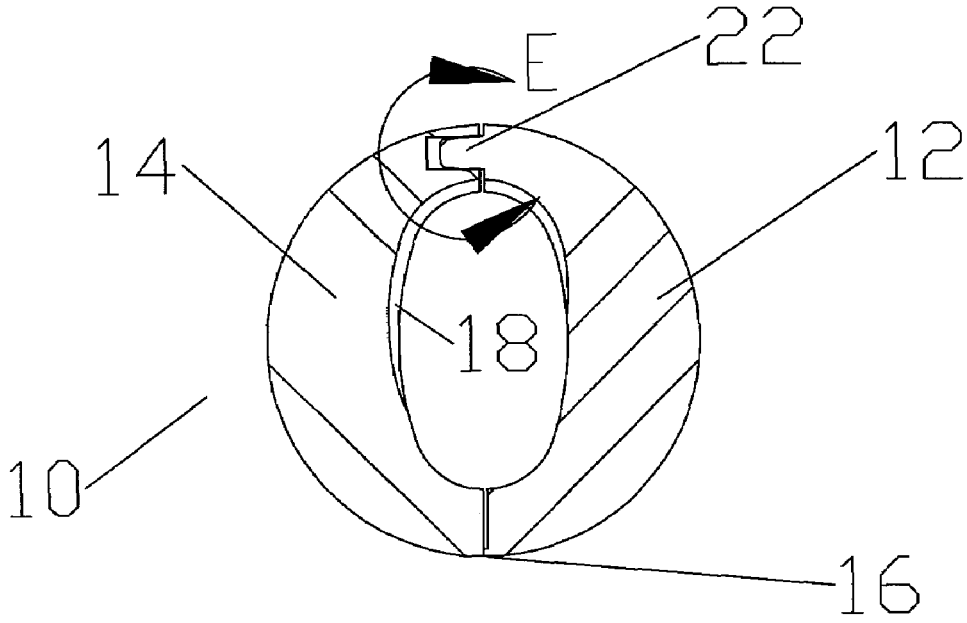
FIG. 5 is a schematic cross section view along line D-D of FIG. 4.
Figure 6:
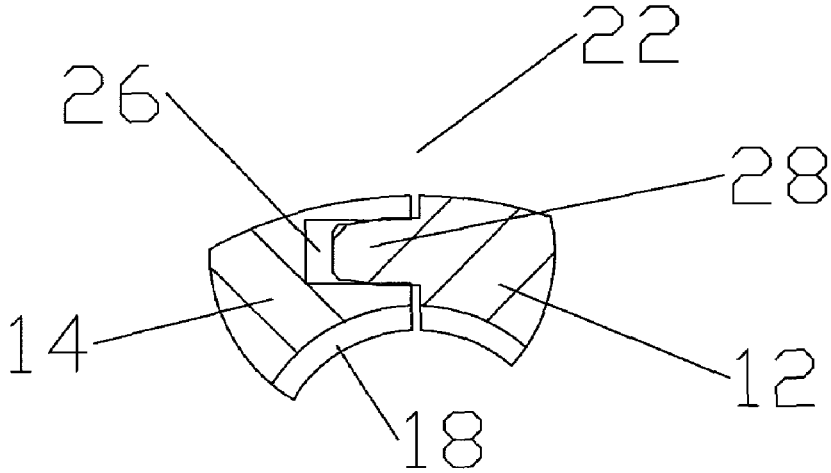
FIG. 6 is a schematic close up view of area E of FIG. 5, showing an exemplary retaining means in the form of an interference fit.

As shown in FIGS. 1-6, a split ring 10 according to an exemplary embodiment of the invention is formed as a single contiguous component. A first half 12 and a second half 14 of the split ring 10 are joined by a web portion 16. The web portion 16 may be dimensioned with respect to the selected split ring 10 material. For example, where a polymer is applied a thinner web portion 16 may be usable according to elastic properties of the polymer, if any. Where a metal alloy is applied, the web portion 16 preferably has a thickness that allows easy folding of the first and second halves 12, 14 toward one another without requiring application of force multiplication means such as hand tools, and also that is not under or oversized such that the web portion 16 fractures upon folding.

An inner surface 18 of each of the first and second halves 12, 14 is formed to match corrugations, if any, of the waveguide 20 exterior around which the first and second halves 12, 14 may be folded towards each other along the web portion 16. Where a material with elastic rather than deformation retention properties along the web portion 16 is applied, to retain the first and second halves 12,14 in a closed position around the waveguide 20, a retaining means 22 (FIGS. 5, 6) may be incorporated into the web portion 16 according to a deformation retention characteristic of the selected material and or applied at the split ring end(s) 24. The retaining means 22 may be formed, for example, as a socket 26 of the second half 14 into which a pin 28 of the first half 12 makes an interference, annular or cantilever snap fit as the first and second halves 12, 14 are closed towards each other by folding along the web portion 16. Alternative retaining means 22 include, for example, a tab into slot or fastener assisted closure.

Figure 7:
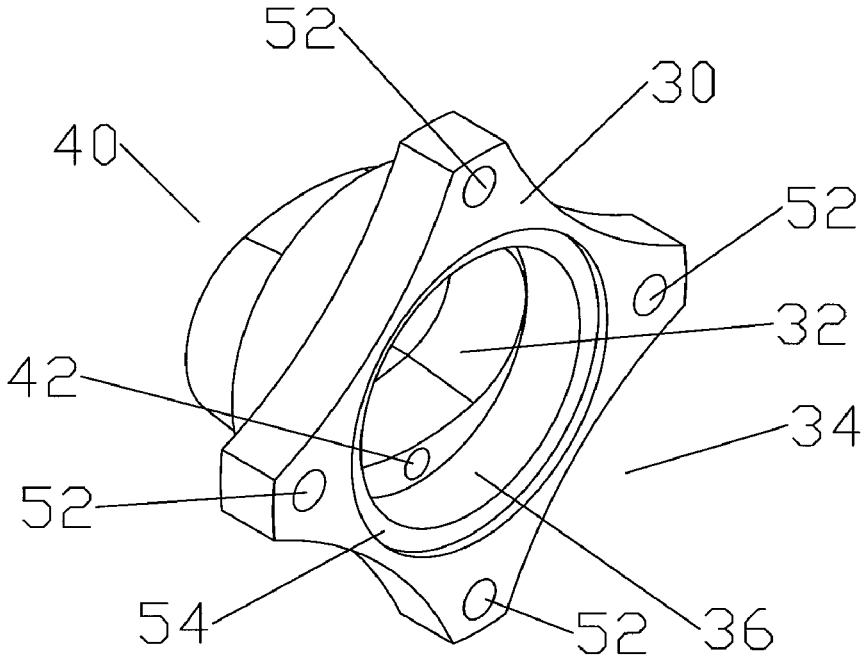
FIG. 7 is a schematic isometric view of an overbody according to the exemplary embodiment.
Figure 8:
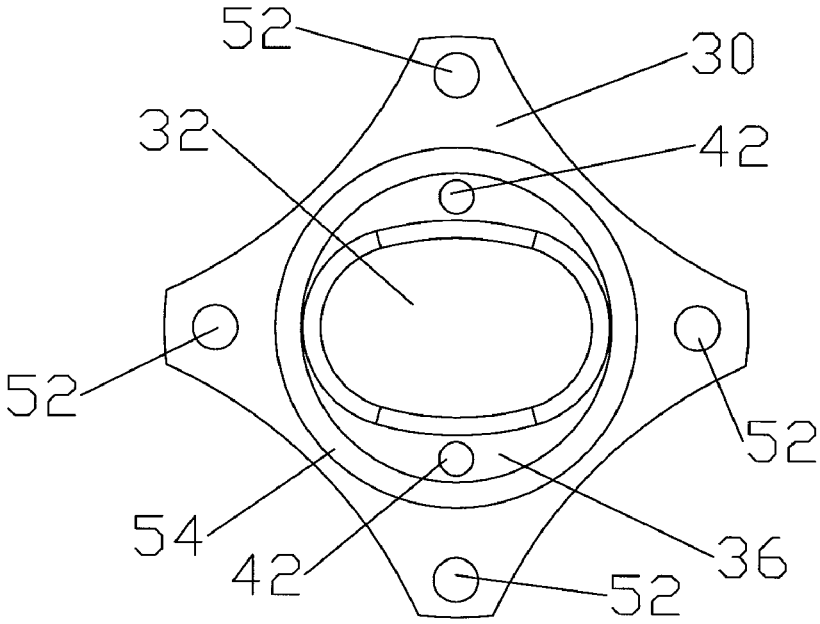
FIG. 8 is a schematic interface end view of the overbody of FIG. 7.
Figure 9:
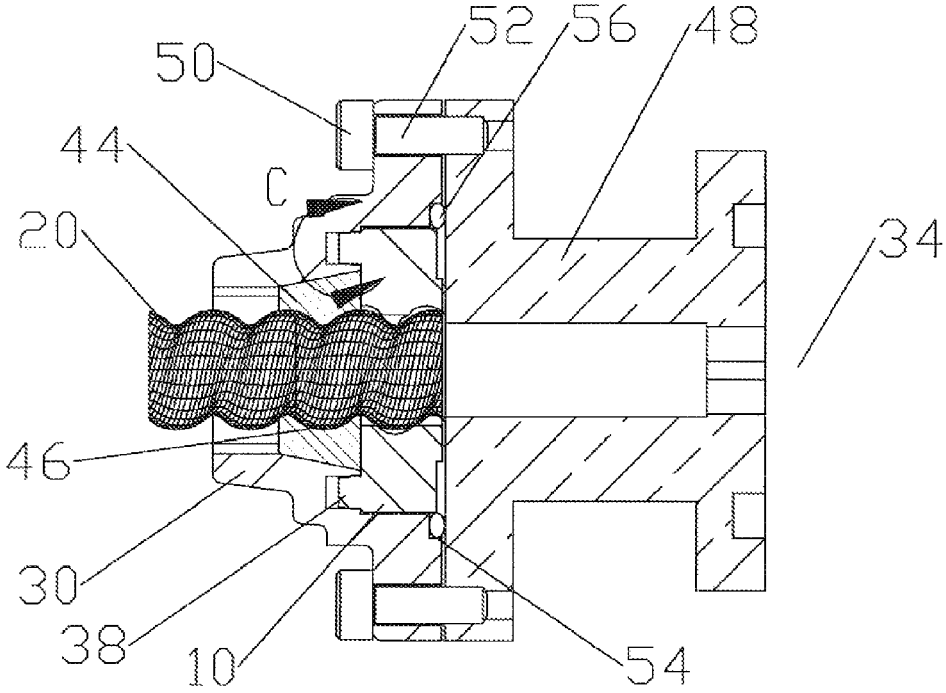
FIG. 9 is a schematic cross sectional view of the exemplary embodiment installed upon a waveguide.
Figure 10:
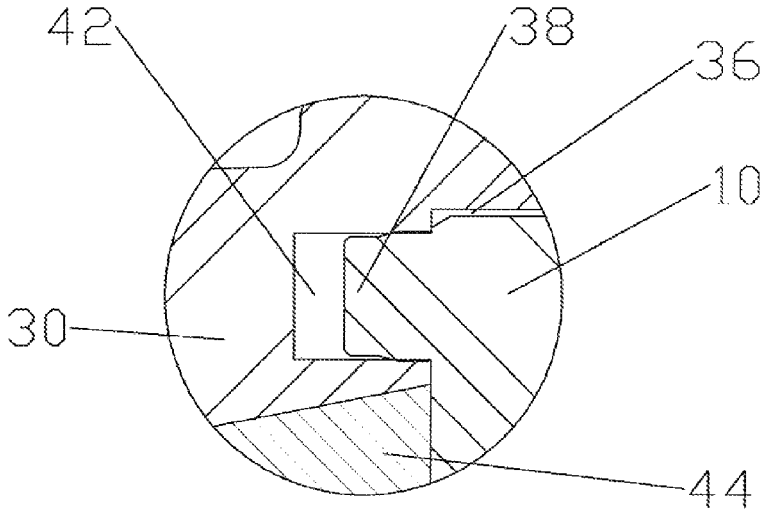
FIG. 10 is a schematic close up view of area C of FIG. 9, showing an exemplary retaining means in the form of an interference fit.

As shown in FIGS. 7 and 8, an overbody 30 has a bore 32 dimensioned to accept the expected waveguide cross section and an interface end 34 with a shoulder 36 formed in the bore 32 is dimensioned to receive the split ring 10. One or more alignment protrusions 38(FIGS. 2, 3 and 4) formed in a waveguide side 40 of the split ring may be positioned to mate with corresponding alignment holes 42 formed in the shoulder 36. As shown in FIGS. 9 and 10, as the overbody 30 is pulled toward a split ring closed around the exterior of waveguide 20, the alignment protrusions 38 key into the alignment holes in, for example, an interference fit, rotationally aligning and retaining the split ring 10 against the shoulder 36 of the overbody 30. Alternatively, the keying between the alignment protrusions and alignment holes may be via annular or cantilever snap fit.

Figure 11:
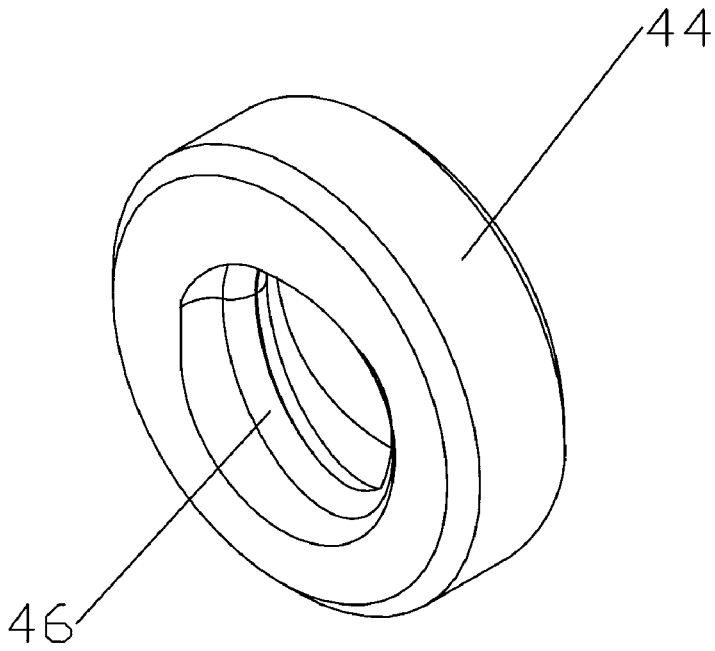
FIG. 11 is a schematic isometric view of a waveguide seal according to the exemplary embodiment.
Figure 12:
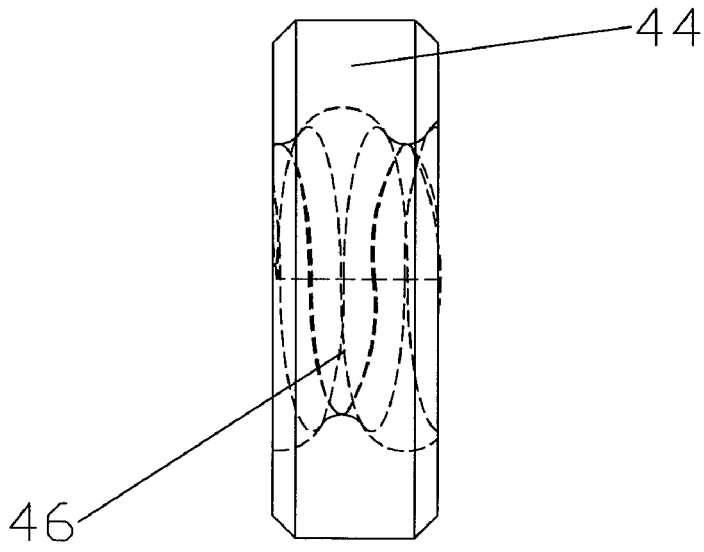
FIG. 12 is a schematic end view of the waveguide seal of FIG. 11.

To environmentally seal the interior areas of the overbody 30, a waveguide seal 44 as shown in figures 11 and 12 may be applied between the overbody 30 and the split ring 10. Preferably, an interior surface 46 of the waveguide seal 44 has features matching the waveguide 20 corrugations.

Once the waveguide 20 is mated with the overbody 30 via the split ring 10, any desired interface element 48 may be securely fastened to the interface end 34, for example via fasteners 50 such as bolts that fit through interface hole(s) 52 of the overbody 30 interface end 34 and thread into the selected interface element 48. An interface sealing groove or sealing shoulder 54 that together with the periphery of the split ring 10 forms a groove may be applied to the interface end 34 of the overbody 30 as a seat for a seal 56 such as an o-ring positioned between the interface element 48 and the overbody 30.

To assemble the waveguide interface upon a waveguide, the waveguide 20 end is passed though the overbody 30 bore 32 and the waveguide seal 44, if present, placed over the waveguide 20 end. The first and second halves 12, 14 of the split ring 10 are folded along the web portion 16 to mate the split ring 10 with the exterior of the waveguide 20. A retaining means 22 such as the pin 28 and socket 26 are joined to retain the first and second halves 12, 14 around the exterior of the waveguide 20. The overbody 30 is then drawn towards the split ring 10 to compress the waveguide seal 44 and seat the split ring 10 within the interface end 34 shoulder 36. If present, alignment protrusions 38 of the split ring 10 seat within alignment holes 42 of the interface end shoulder in an interference fit. If applicable, the interface end 34 of the waveguide 30 is flared against the interface end 34 of the split ring 10 and a desired interface element 48 fastened to the interface end 34 of the overbody 30.

One skilled in the art will appreciate that the split ring 10 and overbody 30 may be configured with no overhanging edges or threading as shown for example in FIGS. 1, 2, 7, 8 and 15-19. This enables application of precision injection molding, die casting and or thixotropic metal molding technologies to cost effectively form these components from polymers or metal alloys as desired. Thereby, precision tolerances are achieved, eliminating the expense and materials waste inherent with the prior precision metal machining production steps.

In addition to materials cost savings, the use of polymers enabled by the invention significantly reduces the weight of the resulting assembly.

Figure 13:
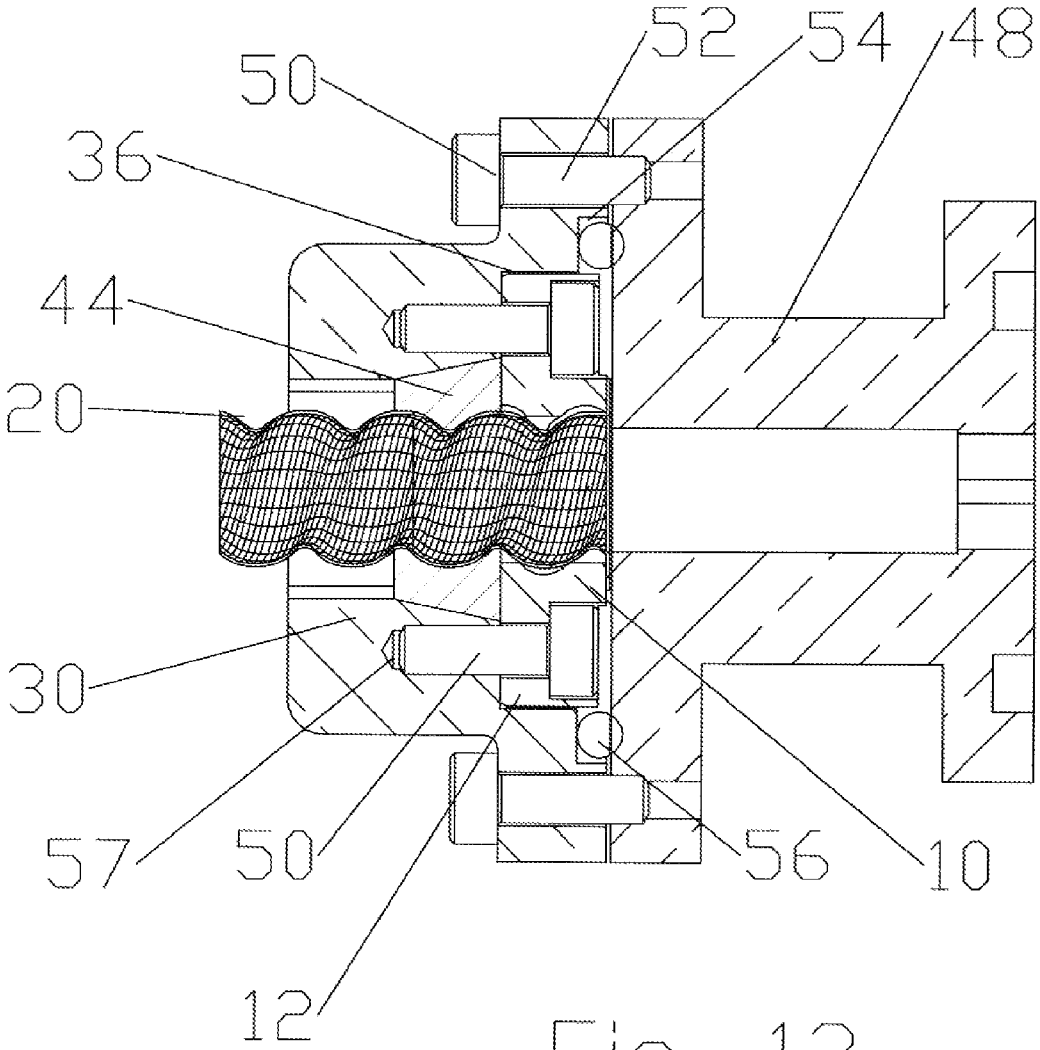
FIG. 13 is a schematic cross sectional view of a first alternative embodiment installed upon a waveguide.
Figure 14:
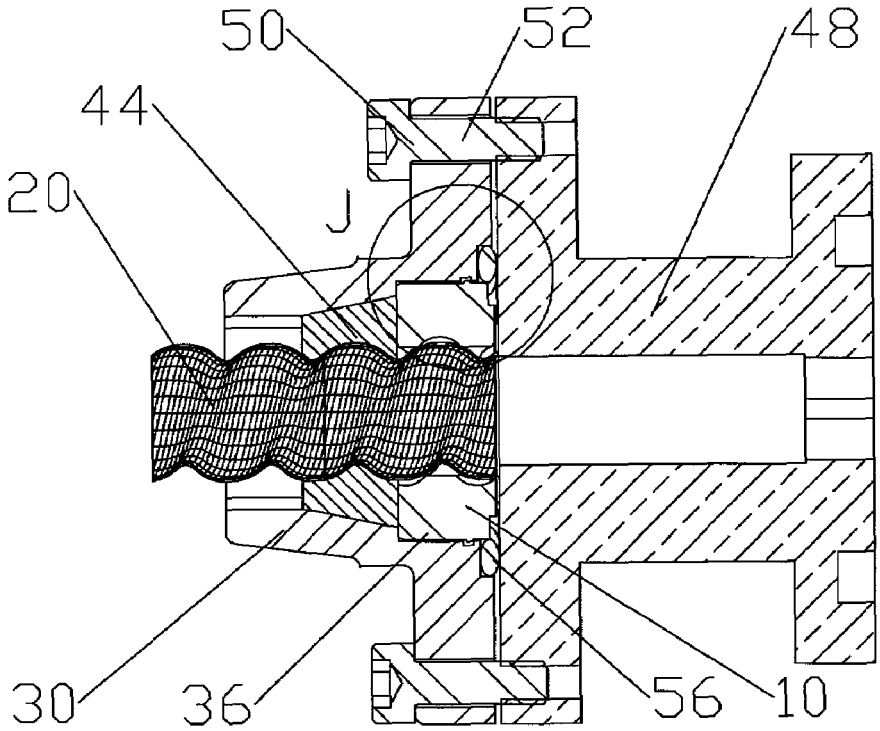
FIG. 14 is a schematic cross sectional view of a second alternative embodiment installed upon a waveguide.
Figure 15:
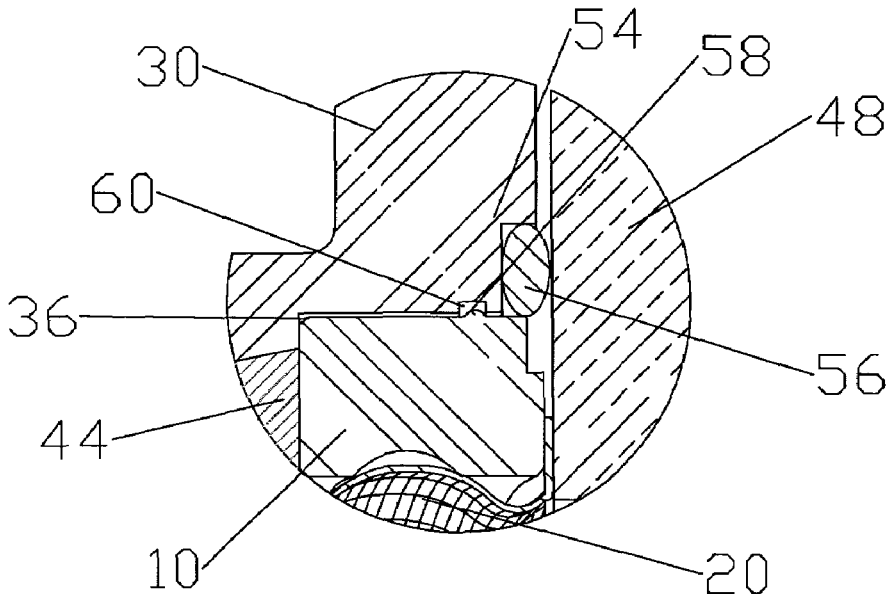
FIG. 15 is a schematic close up view of area J of FIG. 14.
Figure 16:
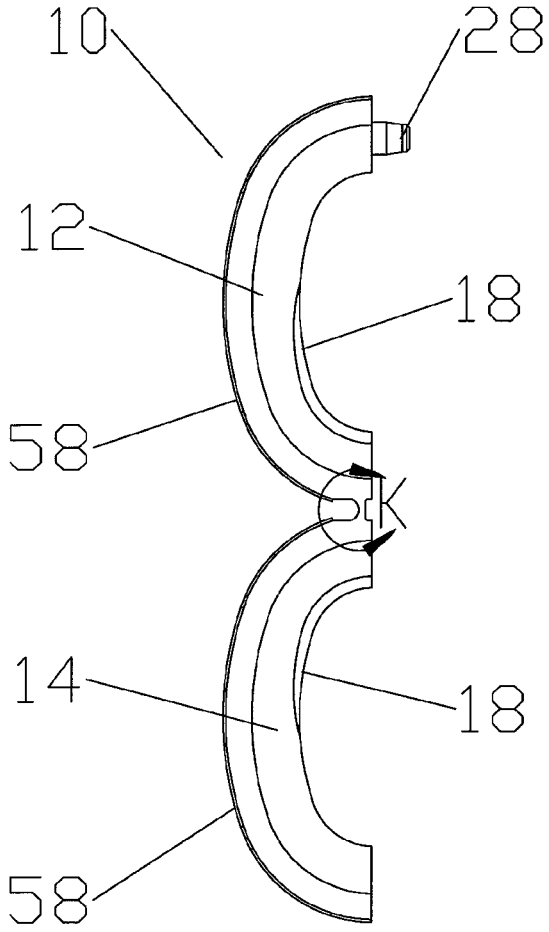
FIG. 16 is a side schematic view of a split ring, according to the second alternative embodiment of the invention, in an initial casting configuration.
Figure 17:
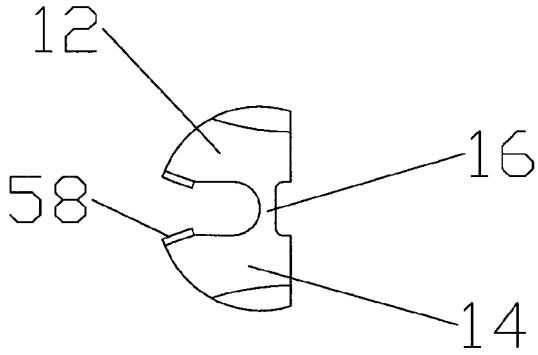
FIG. 17 is a schematic close up view of area K of FIG. 16.
Figure 18:
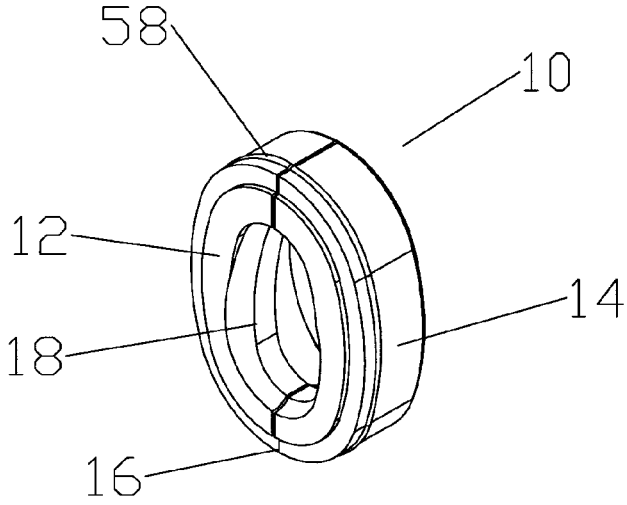
FIG. 18 is a schematic isometric view of the split ring of FIG. 16, folded along the web portion and interconnected end to end.
Figure 19:
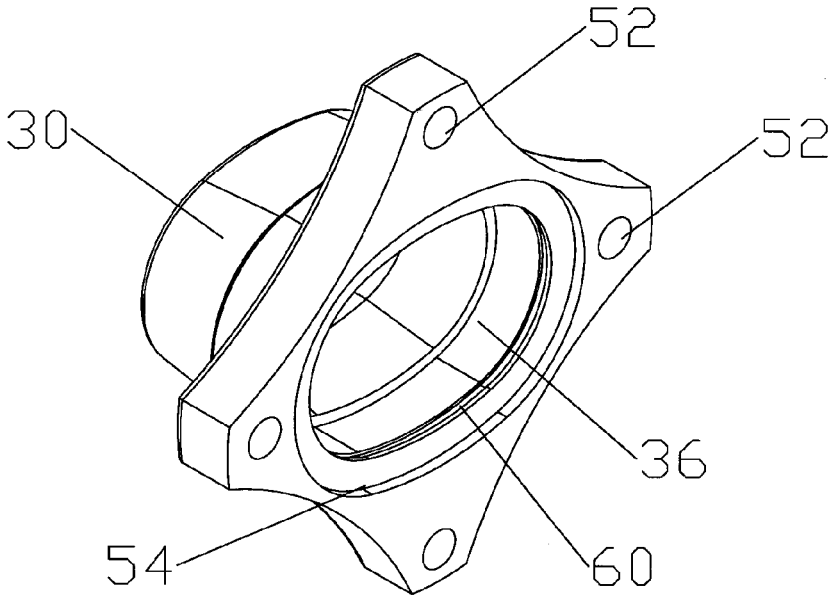
FIG. 19 is a schematic interface end view of an overbody, according to the second alternative embodiment of the invention.

A first alternative embodiment, as shown in FIG. 13, demonstrates that the single piece, for example, die cast split ring 10 may apply conventional fastener(s) 50 such as screws that thread into threaded hole(s) 57 formed in the shoulder 36 of overbody 30. Where the split ring 10 and web portion 16 (FIGS. 1 and 2) are formed from a material, such as a metal alloy, with deformation retention properties, the web portion 16 (FIGS. 1 and 2) once in the folded position, without more, may be sufficient to retain the first and second halves 12, 14 in a closed position around the waveguide 20 exterior before the overbody 30 is fitted, allowing further retaining means 22 (FIGS. 5 and 6) to be omitted.

A second alternative embodiment, as shown for example in FIGS. 14-19, demonstrates how the overall materials requirements and size of the wave guide interface may be minimized. An alignment and split ring 10 to shoulder 36 retention function is performed by an outer snap protrusion 58 located along the split ring 10 periphery that mates with a corresponding snap groove 60 formed in shoulder 36. To rotationally align the split ring 10 within the overbody 30, the periphery of the split ring 10 and the corresponding shoulder 36 of the overbody 30 are formed with a non-circular cross section, locking rotational alignment of the split ring 10 and overbody 30 upon insertion. Although the presence of the snap groove 60 complicates molding of the overbody 30 and or introduces an additional machining requirement, the materials savings and overall weight reduction of the resulting waveguide interface is significant.

The waveguide interface adapter is demonstrated in exemplary embodiments herein with respect to a waveguide 20 having an elliptical cross section and helical corrugations. One skilled in the art will appreciate that the invention is similarly applicable to a waveguide 20 having any desired cross section and corrugations, if any, of any configuration.

Table of Parts

| | |
|---|---|
| 10 | split ring |
| 12 | first half |
| 14 | second half |
| 16 | web portion |
| 18 | inner surface |
| 20 | waveguide |
| 22 | retaining means |
| 24 | split ring end |
| 26 | socket |
| 28 | pin |
| 30 | overbody |
| 32 | bore |
| 34 | interface end |
| 36 | shoulder |
| 38 | alignment protrusion |
| 40 | waveguide side |
| 42 | alignment hole |
| 44 | waveguide seal |
| 46 | interior surface |
| 48 | interface element |
| 50 | fastener |
| 52 | interface hole |
| 54 | sealing shoulder |

-continued

| Table of Parts | |
|---|---|
| 56 | seal |
| 57 | threaded hole |
| 58 | outer snap protrusion |
| 60 | snap groove |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A waveguide interface for a waveguide, comprising:

a split ring with a first half and a second half joined by a web portion; the split ring first half and the split ring second half having a respective inner surface configured to mate with an exterior of the waveguide, the first half and the second half foldable along the web portion towards each other and around an exterior of the waveguide; and an overbody with a bore dimensioned to receive the waveguide; the bore having a shoulder at an interface end dimensioned to receive the split ring folded around the exterior of the waveguide;

the shoulder and the split ring rotationally interlocked by a non-circular periphery of the split ring.

2. The waveguide interface of claim 1, wherein the split ring is retained in the shoulder by an interconnection between at least one alignment protrusion in a waveguide side of the split ring and least one alignment hole of the shoulder.

3. The waveguide interface of claim 2, where in the interconnection between the at least one alignment protrusion and the at least one alignment hole is via an interference fit.

4. The waveguide interface of claim 1, wherein the split ring has an outer snap protrusion projecting from a periphery of the split ring; the outer snap protrusion dimensioned to seat within a snap groove of the shoulder, retaining the split ring in the shoulder.

5. The waveguide interface of claim 1, wherein the split ring is retained in the shoulder by at least one fastener passing through the split ring and into a threaded hole of the overbody.

6. The waveguide interface of claim 1, further including a retaining means integral with the split ring.

7. The waveguide interface of claim 1, further including a retaining means at an end of the first half of the split ring and an end of the second half of the split ring.

8. The waveguide interface of claim 1, further including a socket of the first half of the split ring and a pin of the second half of the split ring which mate together in an interference fit upon folding of the split ring along the web portion.

9. The waveguide interface of claim 1, wherein the respective inner surface mates with a corresponding helical corrugation of the waveguide.

10. The waveguide interface of claim 1, further including a waveguide seal having a waveguide seal interior surface dimensioned to mate with an exterior of the waveguide; the waveguide seal positioned between the overbody and the split ring around the exterior of the waveguide.

11. The waveguide interface of claim 1, further including an interface sealing shoulder at the interface end of the shoulder.

12. A method for manufacturing a waveguide interface, comprising the steps of:

forming a split ring of polymer material with a first half and a second half joined by a web portion;

the split ring first half and the split ring second half having a respective inner surface configured to mate with an exterior of the waveguide, the first half of the split ring and the second half of the split ring foldable towards each other and around the exterior of the waveguide, along the web portion; and forming an overbody with a bore dimensioned to receive the waveguide therethrough; the bore having a shoulder at an interface end dimensioned to receive the split ring.

13. The method of claim 12, wherein the split ring is formed in a pre-folded configuration with no overhanging edges.

14. A method for manufacturing a waveguide interface, comprising the steps of:

forming a split ring with a first half and a second half joined by a webportion;

the split ring formed via one of die casting, injection molding and thixotropic metal molding;

the split ring first half and the split ring second half having a respective inner surface configured to mate with an exterior of the waveguide, the first half of the split ring and the second half of the split ring foldable towards each other and around the exterior of the waveguide, along the web portion; and forming an overbody with a bore dimensioned to receive the waveguide therethrough; the bore having a shoulder at an interface end dimensioned to receive the split ring.

15. The method of claim 12, wherein the split ring is formed with at least one alignment protrusion dimensioned to seat within at least one alignment hole formed in the shoulder.

16. The method of claim 12, wherein a retaining means is formed integral with the split ring.

17. The method of claim 12, further including forming a socket in the first half of the split ring and a pin in the second half of the split ring which mate together upon folding of the split ring along the web portion.

18. The method of claim 12, wherein the split ring is formed with an outer snap protrusion dimensioned to seat within a snap groove formed in the shoulder.

19. A waveguide interface for a waveguide, comprising:

a split ring with a first half and a second half joined by a web portion; the split ring first half and the split ring second half having an inner surface configured to mate with an exterior of the waveguide, the first half and the second half foldable towards each other and around the exterior of the waveguide, along the web portion;

a socket in the first half of the split ring and a pin in the second half of the split ring mate together in an interference fit upon folding of the split ring along the web portion;

an overbody with a bore dimensioned to receive the waveguide; the bore having a shoulder at an interface end dimensioned to receive the split ring;

the shoulder and the split ring are rotationally interlocked by a non-circular periphery of the split ring; and the split ring having at least one alignment protrusion dimensioned to seat within at least one alignment hole of the shoulder.

* * * * *